United States Patent [19]

Brown

[11] Patent Number: 5,076,069

[45] Date of Patent: Dec. 31, 1991

[54] MEANS AND METHODS FOR MAKING BLOCKS OF CRYSTAL CLEAR ICE

[76] Inventor: Kenneth G. Brown, Wickham Ave., Mattituck, N.Y. 11952

[21] Appl. No.: 614,218

[22] Filed: Nov. 16, 1990

[51] Int. Cl.[5] ..... F25C 1/20

[52] U.S. Cl. ..... 62/308; 62/70; 62/356

[58] Field of Search ..... 62/69, 70, 308, 356

[56] References Cited

U.S. PATENT DOCUMENTS

| | | | |
|---|---|---|---|
| 1,160,945 | 11/1915 | Murphy | 62/356 X |
| 1,185,629 | 6/1916 | Campbell | 62/308 |
| 3,959,981 | 6/1976 | Anderson | 62/70 X |

*Primary Examiner*—William E. Tapolcai

[57] ABSTRACT

Apparatus for making large blocks of crystal clear ice for ice carving has a tank of brine of freezing temperature. A water can filled with water of the size and form of the desired ice block is in the tank. A tube extends down to the bottom of the container. A source of air under pressure about one and three-quarter pounds/-square inch, is connected to the tube to bubble air out of the container to drive air out of the water to be frozen, by bubbling action. A rotating cam is connected to oscillate the tube up and down. A resilient hollow bumper is connected to the bottom of the tube, the cam being designed to raise the tube a predetermined amount, approximately two inches, and then permitting a drop, whereby, as ice forms from the bottom, the tube is gradually retracted so that it will not become frozen in.

1 Claim, 1 Drawing Sheet

MEANS AND METHODS FOR MAKING BLOCKS OF CRYSTAL CLEAR ICE

TECHNICAL FIELD

This invention relates to means and methods for making crystal clear block ice.

BACKGROUND

There is a need for crystal clear block ice for ice carving purposes. To make crystal clear ice, it is necessary that all air be removed from the freezing water, for instance, ordinary ice cubes made in a freezer are full of air and are opaque.

Air may be removed by two methods, stirring and air bubbling. Freezing ice must be continuously stirred. Since a standard three hundred pound block of ice takes about forty-eight hours to freeze, this has to be done by automatic apparatus. A main problem is that ice forms from the bottom of the container upwardly so that the stirring apparatus must be gradually removed so that it will not get frozen in.

The air may also be removed by bubbling air out of the freezing water by forcing air into the bottom of the container. Since ice forms from the bottom, the air tube must be gradually retracted from the botom so that it will not be frozen in.

THE INVENTION

The present invention solves this problem by forcing air through a tube into the bottom of the ice can so that it will bubble out of the top and remove the air. The tube is automatically retracted as the ice forms from the bottom.

In order to retract the tube, the tube is oscillated up and down with a cam mechanism which will permit the tube to be retracted as ice forms on the bottom and the bottom of the tube hits the top of the forming ice, as the top of the ice rises. A resilient bumper on the bottom of the tube prevents the tube from cutting into the ice and plugging up the tube.

OBJECTS OF THE INVENTION

A principal object of the invention is to provide new and improved means for making blocks of crystal clear ice.

Another object of the invention is to provide new and improved means for making large blocks of crystal clear ice for ice carving, comprising: a tank of brine of freezing temperature, a water container of the size and form of the desired ice block in the tank, said container being filled with water, and means to drive air by bubbling action out of the water to be frozen, including a tube extending down to the bottom of the container, a source of air under pressure connected to the tube to bubble air out of the container, and means connected to prevent the tube from being frozen into the freezing block.

Another object of the invention is to provide new and improved means for making large blocks of crystal clear ice for ice carving, comprising: a tank of brine of freezing temperature, a water container or can of the size and form of the desired ice block in the tank, said container being filled with water, and means to drive air by bubbling action out of the water to be frozen, including a tube extending down to the bottom of the container, a source of air under pressure connected to the tube to bubble air out of the container, and means connected to prevent the tube from being frozen into the freezing block wherein the means to retract the tube as ice forms from the bottom comprises: a rotating rubber friction cam connected to oscillate the tube up and down, the cam being designed and connected to raise the tube a predetermined amount, for instance, two inches, twice a minute, and then permitting it to drop, whereby, as ice forms from the bottom, the tube is gradually retracted so that it will not become frozen in. The best rate is a one R.P.M. gear motor raising tube twice per minute.

BEST MODE OF THE INVENTION

Figure 1:
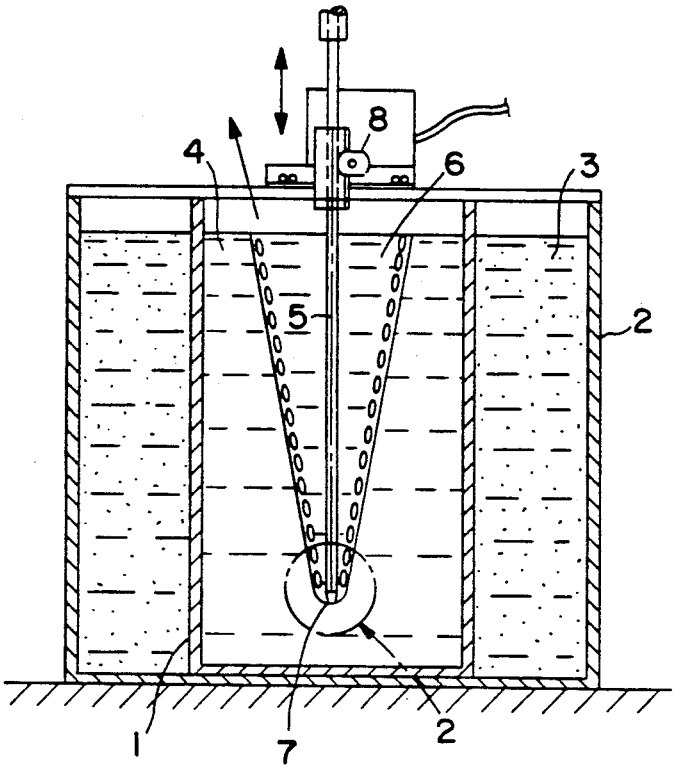
FIG. 1 is a side sectional view of an embodiment of the invention.

Referring to FIG. 1, the ice block is formed in the container 1. It may be, for instance, of a size sufficient to make a three hundred pound block of ice. The container 1, is mounted in the tank 2, which is filled with brine 3, which is kept at below freezing temperature. The container 1, is filled with water 4, which is frozen into a block of ice and in order to obtain crystal clear ice, it is necessary to remove all air from water 4. This is done by forcing air under pressure approximately forty-two inches of water pressure or one and three-quarter pounds air pressure, through the tube 5, to the bottom of the container 1. The air will bubble up as shown at 6, and escape into the atmosphere as shown by the arrow.

Included is an air regulator valve so that when the can is half frozen the air pressure has to be reduced to prevent over-bubbling and blowing water out of can.

The main problem is that the tube 5 may be frozen into the block of ice being formed. Ice will form in the container 1, from the bottom and work its way up. In order to prevent the tube 5, from being frozen into the block as the top edge of the ice 7 rises, means are provided to raise the tube 5, so it will not become frozen in.

Means to raise the tube 5, comprises a rubber cam 8, having two flat sides, connected to motor 9. The cam is rotatably mounted so that it presses against the tube 5 so as to raise the tube 5, periodically and drop it so that it will fall by gravity again into contact with the top of the ice 7. A hollow plastic or rubber bumper 10, is provided so that the tube will not cut into the top of the ice being formed.

Therefore, as the level of ice 7, rises up to the top of the container 1, the tube 5, is automatically retracted so that it will not become frozen in the ice block being formed. Then the cam 8 assembly and tube 5 are removed, leaving a block of crystal clear ice.

Figure 2:
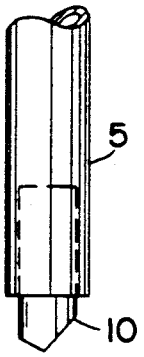
FIG. 2 is a detail view of area 2, FIG. 1.

FIG. 2 shows tube 5, and hollow bumper 10.

Figure 3:
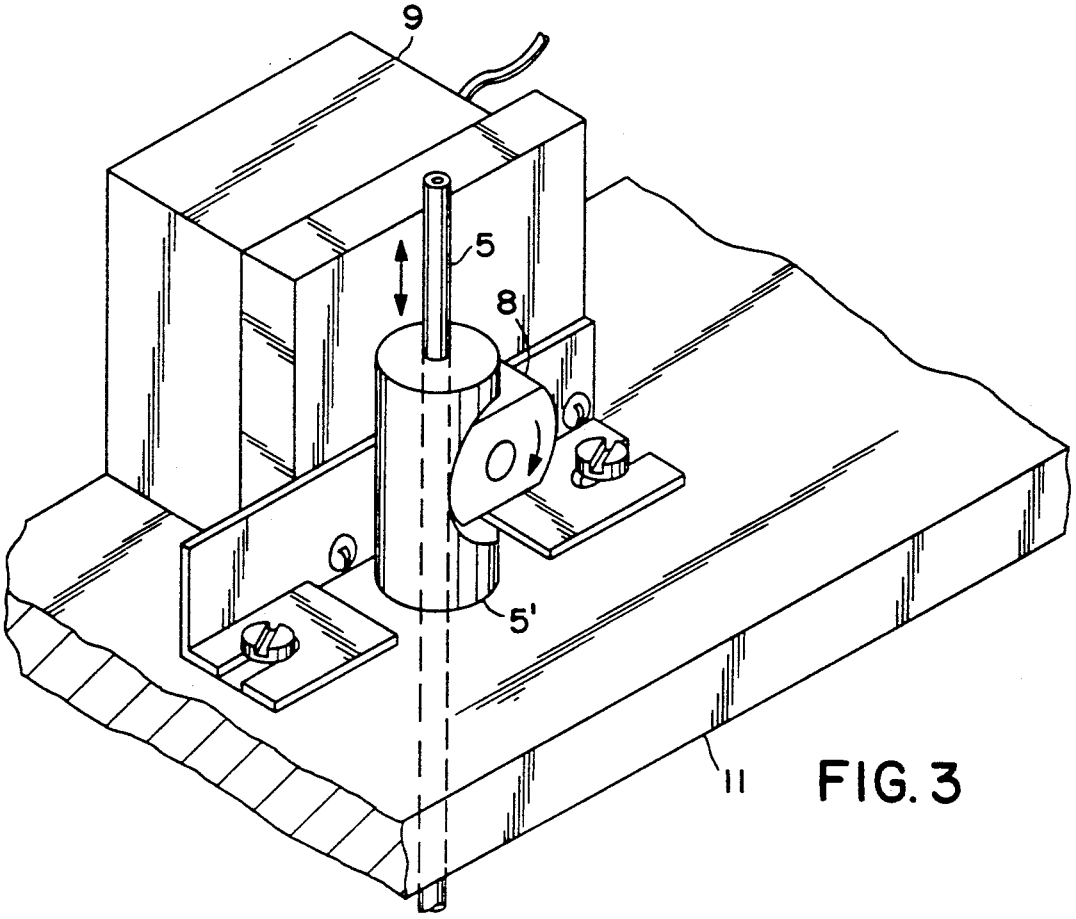
FIG. 3 is a perspective view of an embodiment of the invention.

FIG. 3 shows motor 9, on tank cover 11, connected to rotate cam 8, which periodically raises and drops cam follower 5' and tube 5.

The water should be well filtered, for instance; with a mixed bed de-ionizer.

It is claimed:

1. Means for making large blocks of crystal clear ice for ice carving, comprising:

a tank of brine of freezing temperature, a water container can of the size and form of the desired ice block, in the tank, said container can being filled with water, and means to drive air by bubbling action out of the water to be frozen, including a tube extending down to the bottom of the container, a source of air under pressure connected to the tube to bubble air out of the container can, and means connected to prevent the tube from being frozen into the freezing block, wherein the means to prevent the tube from being frozen into the freezing block, comprises: means to retract the tube as ice forms from the bottom, including a rotating cam connected to oscillate the tube up and down, a resilient hollow bumper, inside the tube of a smaller diameter than the tube connected to the bottom of the tube, the cam being designed and connected to raise the tube a predetermined amount and then permitting it to drop, whereby as ice forms from the bottom, the tube is gradually retracted so that it will not become frozen in.

* * * * *